9/23/86 XR 4,613,386

United States Patent [19]

Yates et al.

[11] Patent Number: 4,613,386

[45] Date of Patent: Sep. 23, 1986

[54] METHOD OF MAKING CORROSION RESISTANT MAGNESIUM AND ALUMINUM OXYALLOYS

[75] Inventors: Ronald L. Yates; Patrick L. Hagans, both of Midland, Mich.

[73] Assignee: The Dow Chemical Company, Midland, Mich.

[21] Appl. No.: 574,212

[22] Filed: Jan. 26, 1984

[51] Int. Cl.[4] ..... C22C 32/00

[52] U.S. Cl. ..... 148/13; 219/121 LM; 219/121 LF; 428/639; 428/640; 428/632; 148/13.1; 148/420; 148/440

[58] Field of Search ..... 148/13, 13.1, 127, 39.32, 148/406, 420, 440, 417; 219/121 LM, 121 LE, 121 LF; 428/610, 639, 640, 632

[56] References Cited

U.S. PATENT DOCUMENTS

| | | | |
|---|---|---|---|
| 3,885,959 | 5/1975 | Badia et al. | 75/138 |
| 4,122,240 | 10/1978 | Banas et al. | 428/655 |
| 4,157,923 | 6/1979 | Yen et al. | 148/4 |
| 4,292,079 | 9/1981 | Pickens et al. | 75/232 |

FOREIGN PATENT DOCUMENTS

| | | | |
|---|---|---|---|
| 21534 | 2/1976 | Japan | 428/632 |
| 47843 | 3/1982 | Japan | 148/420 |
| 74067 | 3/1983 | Japan | 148/440 |
| 48620 | 3/1983 | Japan | 148/13 |
| 2039964 | 8/1980 | United Kingdom | 148/13 |

OTHER PUBLICATIONS

Jain, A. K. et al., "Laser Treatment of Chromium Films on Aluminum at High Power Densities", Thin Solid Films, v86, 1981, pp. 1-9.

*Primary Examiner*—Christopher W. Brody
*Attorney, Agent, or Firm*—James H. Dickerson

[57] ABSTRACT

The invention is an oxalloy consisting essentially of about 5 to about 57 weight percent magnesium or aluminum and about 0.5 to about 10 weight percent of one or more alloying materials selected from the group consisting of B, Al, Si, Ti, V, Cr, Mn, Fe, Co, Ni, Cu, Zn, Ge, As, Zr, Nb, Mo, Ru, Rh, Pd, Ag, Cd, Ga, In, Sn, Sb, Hf, Ta, W, Re, Os, Ir, Pt, Au, Tl, Pb, Bi, Th, and rare earths; and the remainder oxygen.

The invention also includes a method for forming the above oxalloys and a substrate coated with the oxalloys of the present invention.

43 Claims, No Drawings

METHOD OF MAKING CORROSION RESISTANT MAGNESIUM AND ALUMINUM OXYALLOYS

This invention relates to magnesium and aluminum oxalloys and specifically to oxalloys of magnesium or aluminum with alloying materials selected from the group consisting of B, Al, Si, Ti, V, Cr, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, rare earths, alloys thereof, oxide-containing salts thereof, mixtures thereof and oxides of Ga.

BACKGROUND OF THE INVENTION

Magnesium and aluminum and their alloys are widely used for a variety of consumer products and in various industrial processes. Magnesium and aluminum are, however, subject to pitting corrosion and a variety of coatings have been applied to them to minimize such corrosion.

One particularly convenient method for providing corrosion protection for magnesium or aluminum is shown in U.S. Pat. No. 4,401,726. There, magnesium or aluminum was alloyed with a metal selected from the group consisting of Mo, W, Cr, V, Hf, Zr, Fe, B, Be, Ni, Co, Ta, Cb, Ti, Pd, Th, Rh, Re, Os, Ir, Pt, Cu, Au, and Mn. Such alloys were taught as providing corrosion protection and were formed by depositing a layer of alloying metal powder about 1.5 millimeters thick onto a magnesium or aluminum substrate and irradiating it with a laser beam. Irradiation was conducted in inert atmospheres to prevent oxidation of the metals. The laser radiation melted the alloying metal powder and a thin layer of the surface of the magnesium or aluminum substrate. The molten metals were mixed by thermal currents and maintained in a molten state for from about one to about two seconds or less. Then the mixture was solidified into crystalline microstructures.

Materials coated in this manner were thought not only to be corrosion resistant, but to be harder, stronger and more wear resistant than uncoated magnesium or aluminum.

Jain, Kulkarni and Sood ("Laser Treatment of Chromium Films on Aluminum at High Power Densities", *Thin Solid Films*, Volume 86 (1981) pages 1-9) irradiated Cr which had been deposited onto an aluminum substrate. The irradiation was conducted in the presence of air. However, they irradiated the coated substrate with a single laser pulse to determine its effect. They did not recognize that they may have formed mixed oxides nor did they recognize the highly beneficial corrosion resistance shown by such alloys.

It would be desirable to have magnesium and aluminum alloys which may be formed without the need for special inert atmospheres during alloying. It would also be desirable to have new alloys of magnesium and aluminum which are resistant to pitting corrosion.

It is an object of the present invention to provide alloys of magnesium or aluminum which are more resistant to pitting corrosion than unalloyed magnesium or aluminum.

SUMMARY OF THE INVENTION

The invention is an oxalloy consisting essentially of about 5 to about 57 weight percent magnesium containing material or aluminum containing material and about 0.5 to about 10 weight percent of one or more alloying materials selected from the group consisting of B, Al, Si, Ti, V, Cr, Mn, Fe, Co, Ni, Cu, Zn, Ge, As, Zr, Nb, Mo, Ru, Rh, Pd, Ag, Cd, Ga, In, Sn, Sb, Hf, Ta, W, Re, Os, Ir, Pt, Au, Tl, Pb, Bi, Th, and rare earths; and the remainder oxygen.

The invention also includes a method for forming the above oxalloys and a substrate coated with the oxalloys of the present invention.

DETAILED DESCRIPTION OF THE INVENTION

It has been discovered that oxalloying magnesium containing material or aluminum containing material with alloying materials in the presence of oxygen with a beam of high energy radiation produces oxalloys that are surprisingly resistant to corrosion.

"Oxalloy" means a molecular mixture of oxidized elements, whether crystallized or amorphous.

"Alloy" means a solid or liqiud mixture of two or more metals.

"Magnesium containing material" means (1) magnesium, (2) alloys having magnesium as the predominant component, or (3) oxygen containing salts of magnesium such as magnesium oxides, magnesium nitrates, magnesium carbonates, and magnesium sulfates.

"Aluminum containing material" means (1) aluminum, (2) alloys having aluminum as the predominant component, or (3) oxygen containing salts of aluminum such as aluminum oxides, aluminum nitrates, aluminum carbonates, and aluminum sulfates.

"Alloying Materials" means materials selected from the group consisting of B, Al, Si, Ti, V, Cr, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, rare earths, alloys thereof, oxide-containing salts thereof, mixtures thereof and oxides of Ga.

"Substrate" means the body upon which a thin layer of alloying materials is deposited. The substrate may be magnesium containing material or aluminum containing material or it may be one or more alloying material selected from the group consisting of B, Al, Si, Ti, V, Cr, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, rare earths, alloys thereof, oxide-containing salts thereof, mixtures thereof and oxides of Ga.

Oxalloys described in the present invention may be formed in a variety of ways, including being formed by surface alloying techniques using high energy radiation in the presence of oxygen. Suitable methods for forming surface alloys are described in U.S. Pat. Nos. 4,157,923 and 4,401,726; the teachings of which are hereby incorporated by reference. The methods taught in these patents are applicable to the method of the present invention, keeping in mind the present invention includes irradiating in the presence of oxygen, while the prior art irradiated in inert atmospheres.

In forming the oxalloys of the present invention, it is necessary to physically contact magnesium containing material or aluminum containing material with alloying materials and irradiate the contacted metals with a beam of high energy radiation to heat and disperse the materials and form oxalloys. The irradiation must be carried out in the presence of oxygen. Deposition of the alloying material and its irradiation may be conducted simultaneously using a technique whereby the alloying material is present in the gas phase. The laser beam causes the alloying material to deposit onto the substrate. In the following discussion, the invention is described as forming the oxalloys of the present invention using surface alloying techniques. It is important to keep in mind that substrates are not necessary to the formation of the oxalloys of the present invention. Rather, magnesium containing material or aluminum containing material may be in the form of sheets which are contacted with sheets of alloying materials.

Surface alloying techniques involve depositing a thin film of an alloying materials onto substrates. In the present invention, the substrate is a magnesium containing material or aluminum containing material and the alloying material is one or more materials selected from the group consisting of B, Al, Si, Ti, V, Cr, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, rare earths, alloys thereof, oxide-containing salts thereof, mixtures thereof and oxides of Ga. This minimizes the cost of the overall coated substrate since magnesium containing materials or aluminum containing materials are generally cheaper than most of the alloying materials. Preferably the alloying materials are B, Al, Si, Ti, V, Cr, Fe, Ni, Cu, Zn, Zr, Nb, Mo, Ag, Au, and Pb, oxides thereof, alloys thereof mixtures thereof, and oxide-containing salts thereof.

It should be understood that the use of the materials could be reversed, i.e., magnesium containing material or aluminum containing material could be the alloying materials and deposited onto a substrate in a thin layer for oxalloying. However, for the sake of convenience and economics, magnesium containing materials or aluminum containing materials will be discussed as being the substrate. In the case where the alloying material is the substrate and magnesium is deposited thereon, magnesium has a tendency to melt and vaporize before the substrate metal melts. Thus, in this case, only a minimum amount of magnesium oxalloy is formed.

The thickness of the substrate is not critical to the successful formation of the oxalloys of the present invention. Preferably, for a continuous wave laser, it should be of sufficient thickness to provide a heat sink to absorb a substantial portion of the heat from the beam of high energy radiation. This results in rapid cooling, or quenching, of the coated substrate.

Likewise, the shape of the substrate is not critical to the successful formation of the oxalloys of the present invention, so long as the surface upon which the oxalloys are to be formed is accessible to the beam of high energy radiation.

To practice the method of the present invention, it is ncessary to provide a thin film of the alloying materials onto the substrate. A variety of techniques may be used including, but not limited to, sputtering, plasma spraying, electroplating, dipping, vapor deposition, and laying a powder or film onto the surface of the substrate. Methods for depositing materials in thin films are well known in the art and are shown for example in Kirk-Othmer Encyclopedia of Chemical Technology, Third Edition Volume 15, pages 241–274 and Volume 13, pages 706–719, John Wiley & Sons, New York, (1979), the teachings of which are hereby incorporated by reference.

Film thicknesses which are used in the present invention depend upon the amount of energy that will be applied by the beam of high energy radiation and upon the desired composition of the resulting oxalloy. They should at least be of sufficient thickness to provide an operable amount to form the oxalloys of the present invention. Coatings may be from about 100 angstroms thick to about 1 to about 3 millimeters thick. Preferably, the coating layer is from about 200 angstroms to about 0.5 millimeter thick. More preferably, the coating layer is from about 200 angstroms thick to about 10,000 angstroms thick and most preferably, the coating layer is from about 300 angstroms to about 3,000 angstroms thick. When the coated substrates of the present invention are used to provide corrosion protection, film thicknesses of between about 500 angstroms and about 2,000 angstroms have been found to be suitable.

Oxygen must be present during the irradiation of the coated substrate to provide enhanced corrosion protection. Oxygen may conveniently be provided from the gaseous atmosphere surrounding the coated substrate during irradiation. In such a case, the atmosphere should contain at least more than an impurity level of oxygen. Preferably, the atmosphere contains at least about 1 volume percent oxygen, and more preferably, the atmosphere is air. Suitable oxygen atmospheres may contain up to, and including, 100 percent oxygen.

When oxygen is provided from the gaseous atmosphere surrounding the substrate during irradiation, the beam of high energy radiation melts a portion of the substrate and, depending upon the alloying material, may melt the alloying material. During the time that these materials are in a molten state, the oxygen in the atmosphere reacts with the materials to produce oxalloys.

Optionally, the oxygen source may be one or more of the materials being alloyed. For example, the oxygen may be provided from oxides, nitrates, sulfates or carbonates of magnesium containing materials or aluminum containing materials. Likewise, the oxygen may be provided from an oxide of B, Al, Si, Ti, V, Cr, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, Ga or rare earths.

When oxygen is provided from one of the materials being alloyed and the substrate is magnesium or aluminum, the beam of high energy radiation may not heat the material to its melting point, however, in such a case, it does melt the magnesium or aluminum and causes it to mix with the oxide material yielding an oxalloy.

In the case where oxygen is provided from one of the materials being oxalloyed and where the beam of high energy radiation decomposes the metallic oxide before the magnesium or aluminum melts, oxygen is released. However, before the oxygen has time to diffuse out of the substrate/alloying material interfacial area, it is thought reacts with molten materials and form oxalloys.

In the embodiments of the present invention in which oxygen is provided from one of the materials, the source of the beam of high energy radiation may be an electron gun, a laser, or other suitable high energy radiation sources. However, in the embodiments of the present invention where oxygen is provided from the atmosphere surrounding the substrate, an electron gun is not suitable. In that case, a laser or other suitable high energy radiation source is preferably used. In either of the embodiments, the preferred source of the radiation is a laser because lasers produce high energy densities and cause rapid heating and cooling of the substrate.

Any type laser is suitable for use, however, pulsed lasers are preferred for use in embodiments employing alloying material layers having thicknesses of about 10,000 angstroms or less because they produce high energy densities and produce extremely rapid heating and cooling of the substrate. Continuous wave lasers may optionally be used, but the beam of high energy radiation must be rapidly moved across the surface of the coated substrate or, conversely, the substrate must be rapidly moved across the beam of high energy radiation.

In those embodiments where the coating is thicker than about 10,000 angstroms, either continuous wave lasers or pulsed lasers are suitable. Thus, continuous wave lasers may be thought of as more suitable for use in embodiments employing generally thicker layers of alloying materials. The Kirk-Othmer Encyclopedia of Chemical Technology, Third Edition, Volume 154, pages 42–81, John Wiley & Sons, New York (1979), describes various types of lasers and their uses.

Regardless of the source of the beam of high energy radiation, it is necessary to transmit an adequate amount of energy to the coated surface of the substrate to rapidly heat the coated surface of the substrate. The amount of energy necessary to provide such heating depends upon the thickness and type of alloying materials used, and the type, and thickness, of the magnesium containing material or aluminum containing material substrate. Generally, the source of radiant energy should provide a power density of at least about $1\times10^4$ watts/square centimeter and preferably, between about $10^4$ and about $10^9$ watts/square centimeter.

Using either a pulsed laser or a continuous wave laser, the exposure time of the laser onto the substrate may be used to control the amount of energy transmitted onto the surface of the coated substrate. The proper exposure time of the beam of high energy radiation depends upon the thickness of the coating, the chemial composition of the coating, the type of laser being used, and the chemical composition of the substrate material. The exposure time should be of sufficient length to heat and disperse the alloying materials with the substrate material. However, it should not be so lengthy to vaporize, or blow off, a substantial portion of the alloying materials. Exposure times of up to about 1 to about 2 seconds are acceptable. Preferably, however, exposure times are substantially shorter and are in the range of less than about 0.1 second. Most preferably, the exposure times are in the nanosecond range or less. Such short exposure times cause extremely rapid heating and cooling of the alloying metal and the substrate metal. When exposure times are in the nanosecond range or less, heating and cooling rates are from about $10^{10}$ to about $10^{11}$ degrees celsius/second.

The amount of energy transferred to the alloying material coating and to the substrate surface may be controlled by focusing or defocusing the beam of high energy radiation, controlling the exposure time of the beam of high energy radiation, and adjusting the beam power.

The desired depth of the melted area in the practice of the present invention depends upon the desired composition of the oxalloy and the thickness of the alloying materials coating. The greater the melt depth, the more dilute the resulting oxalloy will be in the alloying materials, and hence, the greater the concentration of the substrate material. The depth of the melt should at least be as great as the thickness of the coating plus at least a portion of the thickness of the substrate so oxalloys may be formed. Preferably, the depth of the melt is at least about 150 percent of the thickness of the coating and, more preferably, it is at least about 200 percent of the thickness of the coating. Melt depths of 1000 percent, or greater, of the thickness of the coating are perfectly acceptable. For example, when the coating is about 2000 angstroms thick, the melt depth is preferably about 3000 to about 4000 angstroms, but may be up to about 30,000 angstroms or more.

The cooling rate of the material is important to the formation of oxalloys. If the cooling rate is too low, the components of the oxalloy are thought to separate and form layers. Cooling rates of at least about $10^3$ degrees celsius/second are desired. Preferably, the cooling rates of the material are at least about $10^5$ degrees celsius/-second and more preferably, the cooling rates are at least about $10^{10}$ degrees celsius/second. To minimize gross evaporation of the surface of the substrate, the duration of a continuous beam of high energy beam of radiation on a particular spot should be minimized.

To heat the coated substrate surface to a temperature sufficient to melt the coating and a portion of the adjoining substrate surface, it is convenient to move the substrate through the beam of radiant energy. A particularly convenient method of accomplishing this is by use of a controlled X-Y translational stage or a combination translation stage-rotating wheel. Such items are easily available commercially, for example, from Velmex Company in Bloomfield, N.Y. It is convenient to control translational stages with a computer. In that way, the number of pulses per point and the amount of overlap between successive points may be easily controlled.

After the alloying material coating has been deposited onto the substrate, the coated substrate is subjected to a beam of high energy radiation in the presence of oxygen to quickly heat and disperse the alloying materials with a portion of the substrate material. The turbulence created during this treatment step causes the alloying materials and the substrate material to be intimately mixed and to form an oxalloy.

During irradiation in the presence of oxygen, oxalloys are formed which contain at least a substantial portion of metallic oxides. Such oxalloys are thought to be present substantially completely throughout the thickness of the resolidified layer of material, while the oxalloys on the surface of treated material are thought to be completely oxidized.

An unexpected feature of the oxalloys described in the present invention is the fact that they are surprisingly resistant to pitting corrosion. This fact is particularly useful when they are present on the surface of a magnesium or aluminum substrate because they protect the substrate from pitting corrosion. While not wanting to be held to any particular theory of corrosion and its inhibition, the pitting corrosion resistance of the laser treated surface may be attributed to a novel surface oxalloys.

It is particularly surprising that some of the alloying materials of the present invention provide corrosion protection to magnesium. For example, Ni, Cu and Fe are known to cause severe corrosion in magnesium. See for example U.S. Pat. No. 4,264,362; "Supercorroding Galvanic Cell Alloys For Generation of Heat and Gas"; and "The Technology of Magnesium and Its Alloys" by Adolf Beck, F. A. Hughes Publishers, London (1949).

Magnesium is known to burn when heated in the presence of oxygen. Thus, another particularly suprising feature of the present invention is the fact that magnesium does not burn, or explode, when irradiated in the presence of oxygen.

The present invention is illustrated in the following examples.

EXAMPLE A

This example shows a method for depositing a metallic coating onto the surface of a substrate.

A vanadium coating was applied to a disc of magnesium alloy AZ91C which was about 2 centimeters in diameter and about 3 millimeters thick. AZ91C has a nominal composition of 8.3–9.2 weight percent Al; 0.45–0.9 weight percent Zn; 0.15 weight percent Mn (minimum); 0.20 weight percent Si (maximum); 0.08 weight percent Cu (maximum); 0.01 weight percent Ni (maximum); with the remainder being magnesium. The AZ91C was wet polished using 600 grit SiC paper. Then it was polished using successively smaller grits of alumina (5, 1 and 0.05 microns particle size alumina) suspended in water and applied to Microcloth (a registered trademark of Buehler Limited).

The polished sample was placed in a Materials Research Sputter Chamber Model No. SEM-8620. The vacuum in the chamber was reduced to about $10^{-5}$ to $10^{-6}$ torr. The sample was cleaned with an argon ion sputter (argon at 7 microns pressure at 200 watts) for 1½ minutes. Vanadium was then sputtered onto the surface using a vanadium foil (99.99 percent vanadium) and using argon at 7 microns pressure at 500 watts. Vanadium was deposited until a layer about 1000 angstroms thick resulted. This took about 4 minutes.

EXAMPLE B

A variety of other metals were coated onto a magnesium alloy AZ91C substrate in the manner described in Example A, with the exception of the sputter time. Chromium was applied with a sputter time of 2½ minutes to a thickness of 850 angstroms. Molybdenum was applied with a sputter time of 3 minutes to a thickness of 750 angstroms. Copper was applied with a sputter time of 1½ minutes to a thickness of 1100 angstroms. Iron was applied with a sputter time of 5 minutes to a thickness of 550 angstroms. Nickel was applied with a sputter time of 2½ minutes to a thickness of 700 angstroms. Zr was applied with a sputter time of 5 minutes to a thickness of about 1900 angstroms.

EXAMPLE C

Boron was deposited onto the surface of magnesium AZ91C alloy by dipping a magnesium substrate into a solution of 0.1 molar borax at a temperature of about 25 degrees celsius for from about 5 to about 10 minutes. An electrical voltage was applied at 10 volts D.C. to cause boron oxide to electrodeposit onto the substrate.

EXAMPLE D

This example describes the laser and the sample holding/moving device used in the present invention.

The laser was a Quanta-Ray DCR-1 Model Nd-Yag laser. The wavelength of the laser used to treat most samples was 266 nanometers, a pulse duration of 5 to 7 nanoseconds, and a pulse repetition rate of 10 hertz. Other wavelengths are suitable depending upon the absorption characteristics of the substrate. Such characteristics may be easily determined by known means such as reflectance spectroscopy. The particular adjustment of the wavelength of the laser was selected on the basis of the amount of energy needed to heat the coating and the surface of the substrate to the desired temperature. The amount of energy needed depends upon the chemical and optical components of the coating and the substrate and the thickness of the coating and may be easily determined by routine experimentation. The amount of incident laser energy is easily adjusted by varying the degree of beam focusing. The sample holding device was a computer controlled X-Y translational stage available from Velmex Company, Bloomfield, N.Y. The stage moved during the irradiation. Incremental movement in the X or Y direction was determined by the appropriate computer input to allow for overlap of the laser pulse. This was important to insure uniform melting of the surface.

EXAMPLE 1

This example shows how the coated substrate was exposed to the beam of radiant energy from the laser to form oxalloys.

The coated AZ91C magnesium alloys produced in Examples A, B and C were individually mounted onto a computer controlled translational stage described in Example D. Each was moved through a beam of high energy radiation of the pulsed Nd-Yag laser described in Example D under the following conditions:

| Substrate | Coating | Wavelength (nanometers) | Focused Spot Size (millimeters) | Pulse Energy (millijoules) | Pulses per point |
|---|---|---|---|---|---|
| AZ91C | None (with laser treatment) | 266, 1060 | 0.1 | 3.3 | 1 |
| AZ91C | Borate | 1060 | 0.1 | 10.0 | 2 |
| AZ91C | Borate/silicate | 1060 | 0.1 | 10.0 | 2 |
| AZ91C | Mo | 266 | 0.1 | 3.5 | 1 |
| AZ91C | Cu | 266 | 0.1 | 3.6 | 1 |
| AZ91C | Ag | 266 | 0.1 | 5.0 | 2 |
| AZ91C | Au | 266 | 0.1 | 4.0 | 2 |
| AZ91C | V | 266 | 0.3 | 3.3 | 1 |
| AZ91C | Nb | 266 | 0.3 | 3.1 | 1 |
| AZ91C | Zn | 266 | 0.3 | 0.4 | 1 |
| AZ91C | Cr | 266 | 0.3 | 0.8 | 1 |
| AZ91C | Fe | 266 | 0.1 | 2.5 | 1 |
| AZ91C | Ni | 266 | 0.1 | 2.1 | 1 |
| AZ91C | Pb | 266 | 0.1 | 4.9 | 2 |
| AZ91C | Zr | 266 | 0.1 | 2.5 | 1 |
| AZ91C | Al | 266 | 0.5 | 3.1 | 1 |
| Al | None (without laser treatment) | — | — | — | — |
| Al | Cr | 266 | 0.3 | 4.1 | 1 |

-continued

| Substrate | Coating | Wavelength (nanometers) | Focused Spot Size (millimeters) | Pulse Energy (millijoules) | Pulses per point |
|---|---|---|---|---|---|
| Al | Mo | 266 | 0.1 | 4.0 | 1 |

The irradiation was carried out in air which contains about 20 percent oxygen. Approximately 4 square centimeters of each coated substrate were treated in this way.

The coatings (oxalloys) of the treated samples were analyzed by several methods. Thickness and morphology was determined by use of a S.E.M. (scanning electron microscope) and a profilimeter. The S.E.M. provided a highly magnified visual observation while the profilimeter provided a contour map of the resolidified region.

The elemental composition and the semiquantitative analysis of the detected elements was determined by use of an E.D.S. (Energy Dispersive Spectrometer) attached to the S.E.M. Several typical analyses for coatings resulting from the irradiation of the alloying metal on the magnesium AZ91C are presented below. This technique did not have the ability to detect oxygen.

Relative Atomic Percents of Elements In Laser Irradiated AZ91C Surfaces

| Substrate | Alloying Materials | % Mg | % Al | % Zn | % Fe | % Cu | % Cr |
|---|---|---|---|---|---|---|---|
| AZ91C | Fe | 79.3 | 6.0 | 0.2 | 14.5 | — | — |
| AZ91C | Cu | 89.9 | 8.6 | — | — | 1.4 | — |
| AZ91C | None | 83.9 | 5.2 | — | — | — | — |
| AZ91C | Cr | 87.7 | 6.4 | 0.1 | — | — | 5.8 |

AZ91C magnesium alloy with no surface alloying and without laser treatment was found to contain 96.2 percent Mg and 3.8 percent Al.

The presence of oxides in the coating was detected by several methods. The first was through visual observation. All the samples irradiated with a laser as described in Example D above had a characteristic oxide appearance; i.e., they all were some shade of white to gray in color. Examination of the samples both in a light microscope and a S.E.M. showed the absence of any metallic phases. Several samples were also analyzed with a technique known as E.S.C.A. (Electron Spectroscopy for Chemical Analysis). This technique has the ability to detect oxygen and to determine whether the elements present in the coating are in the elemental or oxide form. In all cases, only the oxides were observed on the surface and to depths of about 1500 angstroms. The compositions were generally in the ranges (for AZ91C):

| Component | Weight % |
|---|---|
| Oxygen | 40–60 |
| Mg | 20–30 |
| Al | 5–15 |
| Alloying Element | 0.5–10 |

Several of the oxalloy coatings were examined with grazing incidence X-ray diffraction and electron diffraction techniques to observe if any amorphous structure had been imparted to the oxalloy. X-ray results for irradiated Cr, Fe, and Cu containing oxalloys on AZ91C indicated that no crystalline phases were formed. Also, the increased inhomogenity of the diffraction lines and the increased background observed for these samples are indicative of an increased amorphous structure.

EXAMPLE 2

An irradiated Mo layer on a thin Al foil was examined with electron diffraction. This was prepared in the same manner as Mo on Mg described in the examples above. A "halo" diffraction pattern was observed indicating the presence of an amorphous oxalloy.

EXAMPLE E

This example shows the procedure for evaluating the corrosion rate of a body.

Samples were examined electrochemically with a technique known as linear sweep polarization to determine their corrosion rates. This method is described in "Electrochemical Corrosion Testing" STP 727 (1981) Mansfield/Bertocci Editors. In this technique the voltage applied to the working electrode (the sample produced in Example C) was scanned at a set rate of 1 millivolt/second from the rest, or open, circuit potential in the positive direction until an abrupt rise in current was observed. This abrupt rise indicated that pitting corrosion had begun. The voltage at which pitting commenced directly correlatable with the corrosion resistance of the sample. The more positive the pitting potential the more corrosion resistant is the sample. The electrolyte used in this test consisted of a pH=9.3 boric acid/sodium tetraborate solution with 1000 parts per million NaCl to induce pitting.

EXAMPLE 3

Samples prepared according to the procedures of Examples A, B, C and D and irradiation as shown in Example 1 were evaluated according to the procedure in Example E to determine their corrosion rate. They were compared with samples which were untreated. The listed pitting potential is the potential as compared to a palladium-hydrogen reference electrode. The following results were obtained:

| Substrate Coating (Oxalloy) | Pitting Potential (volts) |
|---|---|
| AZ91C None (without laser treatment) | −0.43 |
| AZ91C None (with laser treatment) | −0.10 |
| AZ91C Borate | +0.10 |
| AZ91C Borate/-Silicate | +0.15 |
| AZ91C Mo | +0.15 |
| AZ91C Cu | +0.50 |
| AZ91C Ag | −0.05 |
| AZ91C Au | 0.00 |
| AZ91C V | +0.13 |
| AZ91C Nb | −0.08 |
| AZ91C Zn | +0.08 |
| AZ91C Cr | +0.30 |

-continued

| Substrate Coating (Oxalloy) | Pitting Potential (volts) |
|---|---|
| AZ91C Fe | +0.17 |
| AZ91C Ni | +0.25 |
| AZ91C Pb | +0.26 |
| AZ91C Zr | +0.11 |
| AZ91C Al | +0.35 |
| Al None (without laser treatment) | +0.25 |
| Al Cr | +0.88 |
| Al Mo | +0.55 |

Untreated AZ91C magnesium alloy was evaluated according to the procedures of Example E and showed a pitting potential of −0.43 volt. Any values more positive than −0.43 volt indicates an improvement in corrosion resistance. Even magnesium that has no metal alloyed with it but treated with a laser, show improved corrosion resistance. Those samples which are coated with an alloying material and irradiated with a laser to form oxalloys show even a greater resistance to corrosion.

EXAMPLE 4

A nickel coating was applied to a disc of magnesium alloy AZ91C which was about 2 centimeters in diameter and about 3 millimeters thick. AZ91C has a nominal composition of 8.3 to 9.2 weight percent Al; 0.45 to 0.9 weight percent Zn; 0.15 weight percent Mn (minimum); 0.20 weight percent Si (maximum); 0.08 weight percent Cu (maximum); 0.01 weight percent Ni (maximum); with the remainder being magnesium. The AZ91C was set polished using 600 grit SiC paper. Then it was polished using successively smaller grits of alumina (5, 1 and 0.05 micron particle size alumina) suspended in water and applied to Microcloth (a registered trademark of Buehler Limited).

The polished sample was placed in a Materials Research Sputter Chamber Model No. SEM-8620. The vacuum in the chamber was reduced to about $10^{-5}$ to $10^{-6}$ torr. The sample was cleaned with an argon ion sputter (argon at 7 microns pressure at 200 watts) for 1½ minutes. Nickel was then sputtered onto the surface using a nickel target (99.99 percent) and using argon at 7 microns pressure at 500 watts. Nickel was deposited until a layer about 700 angstroms thick resulted. This took about 2½minutes. The nickel coated AZ91C sample was then mounted on a computer controlled X-Y translational stage available from Velmex Company, Bloomfield, N.Y., immediately prior to laser irradiation.

The laser was a Quanta-Ray DCR-1 Model Nd-Yag laser. The wavelength on the laser used was 266 nanometers, a pulse duration of 5 to 7 nanoseconds, and a pulse repetition rate of 10 hertz. The beam was focused onto the coated substrate using a 4 inch lens to a spot size of approximately 0.1 millimeters. The pulse energy of the laser was adjusted to 2.1 millijoules/pulse as measured by an energy metal available from Scientech Corporation, Boulder, Colorado. The irradiations were carried out in the air at room temperature. The speed of the translation stage was synchronized with the laser pulse repetition rate so that the sample was treated with one laser pulse per incremental stage movement which was set at 0.1 mm. Approximately 4 square centimeters was treated in this way.

We claim:

1. A method for forming oxalloys of magnesium containing materials or aluminum containing materials comprising:

contacting an alloying material with magnesium containing materials or aluminum containing materials;

irradiating the contacted materials with a beam of high energy radiation in the presence of oxygen; wherein the irradiation is of sufficient energy to form an oxalloy of at least magnesium or aluminum and at least one alloying material; and exposing at least a portion of the contacted materials to the beam of high energy radiation for a time sufficient to form the oxalloy;

wherein the alloying material is one or more materials selected from the group consisting of B, Al, Si, Ti, V, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, rare earths, oxide containing salts thereof, alloys thereof, and mixtures thereof.

2. A method for forming oxalloys of magnesium containing materials comprising:

contacting magnesium containing materials with an alloying material;

irradiating the contacted materials with a beam of high energy radiation in the presence of oxygen; wherein the orradiation is of sufficient energy to form an oxalloy of at least magnesium and at least one alloying material; and exposing at least a portion of the contacted materials to the beam of high energy radiation for a time sufficient to form the oxalloy;

wherein the alloying material is one or more materials selected from the group consisting of B, Al, Si, Ti, V, Cr, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, rare earths, mixtures thereof, alloys thereof, oxygen containing salts thereof, and oxides of Ga.

3. A method for forming oxalloys of aluminum containing materials comprising:

contacting an alloying material with aluminum containing materials;

irradiating the contacted materials with a beam of high energy radiation in the presence of oxygen, wherein the irradiation is of sufficient energy to form an oxalloy of at least aluminum and at least one alloying material; and exposing at least a portion of the contacted materials to the beam of high energy radiation for a time sufficient to form the oxalloy;

wherein the alloying material is one or more materials selected from the group consisting of B, Si, Ti, V, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, Ga, rare earths, alloys thereof, oxygen containing salts thereof, and mixtures thereof, and oxides of Ga.

4. The method of claim 2 wherein oxygen is provided from the gaseous atmosphere surrounding the contacted materiala.

5. The method of claim 2 wherein the beam of high energy radiation is a laser beam.

6. The method of claim 5 wherein the laser beam is a pulsed wave laser.

7. The method of claim 2 wherein the magnesium containing material is a substrate having the alloying materials present on its surface in a layer having a thickness of less than about 1.5 millimeters.

8. The method of claim 2 including the step of: depositing the alloying materials onto the magnesium containing material using a method selected from the group consisting of sputtering, plasma spraying, electroplating, dipping, vapor deposition and laying the alloying metal onto the surface.

9. The method of claim 8 wherein the alloying material is deposited in a layer having a thickness of less than about 30,000 angstroms.

10. The method of claim 8 wherein the alloying material is deposited in a layer having a thickness of less than about 3000 angstroms.

11. The method of claim 4 wherein the gaseous atmosphere contains greater than about 1 weight percent oxygen.

12. The method of claim 4 wherein the gaseous atmosphere is air.

13. The method of claim 2 wherein the oxygen is provided from an oxide of the alloying materials selected from the group consisting of B, Al, Si, Ti, V, Cr, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, Ga, or rare earths.

14. The method of claim 2 wherein the alloying material is selected from the group of materials consisting of B, Al, Si, Ti, V, Cr, Fe, Ni, Cu, Zn, Zr, Nb, Mo, Ag, Au, and Pb.

15. The method of claim 2 wherein the beam of high energy radiation heats the interface of the contacted materials at a rate of at least $10^3$ degrees celsius per second.

16. The method of claim 2 wherein the beam of high energy radiation heats the interface of the two contacted materials at a rate of at least about $10^{10}$ degrees celsius per second.

17. The product produced by the method of claim 1.

18. The product produced by the method of claim 2.

19. The product produced by the method of claim 3.

20. The product produced by the method of claim 4.

21. The product produced by the method of claim 5.

22. The product produced by the method of claim 6.

23. The product produced by the method of claim 8.

24. The product produced by the method of claim 9.

25. The product produced by the method of claim 10.

26. The product produced by the method of claim 12.

27. The product produced by the method of claim 14.

28. The product produced by the method of claim 16.

29. A method for forming oxalloys of magnesium containing material comprising:

contacting magnesium containing materials with an alloying material;

irradiating the contacted materials with a beam of high energy radiation in the presence of a substantially pure oxygen gaseous atmosphere surrounding the contacted materials; wherein the irradiation is of sufficient energy to form an oxalloy of at least magnesium and at least one alloying material; and exposing at least a portion of the contacted materials to the beam of high energy radiation for a wherein the alloying material is one or more materials selected from the group consisting of B, Al, Si, Ti, V, Cr, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, rare earths, mixtures thereof, oxygen containing salts thereof, and oxides of Ga.

30. A method for forming oxalloys of magnesium containing material comprising:

contacting magnesium containing materials with an alloying material;

irradiating the contacted materials with a beam of high energy radiation in the presence of oxygen provided from at least one of the contacted materials; wherein the irradiation is of sufficient energy to form an oxalloy of at least magnesium and at least one alloying material; and exposing at least a portion of the contacted materials to the beam of high energy radiation for a time sufficient to form the oxalloy;

wherein the alloying material is one or more materials selected from the group consisting of B, Al, Si, Ti, V, Cr, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, rare earths, mixtures thereof, oxygen containing salts thereof, and oxides of Ga.

31. A method for forming oxalloys of magnesium containing material comprising:

contacting magnesium containing materials with an alloying material;

irradiating the contacted materials with a beam of high energy radiation in the presence of oxygen provided from an oxide of magnesium; wherein the irradiation is of sufficient energy to form an oxalloy of at least magnesium and at least one alloying material; and exposing at least a portion of the contacted materials to the beam of high energy radiation for a time sufficient to form the oxalloy;

wherein the alloying material is one or more materials selected from the group consisting of B, Al, Si, Ti, V, Cr, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, rare earths, mixtures thereof, oxygen containing salts thereof, and oxides of Ga.

32. A method for forming oxalloys of magnesium containing material comprising:

contacting magnesium containing materials with an alloying material;

irradiating the contacted materials with a beam of high energy radiation in the presence of oxygen provided from an oxide containing salt of magnesium; wherein the irradiation is of sufficient energy to form an oxalloy of at least magnesium and at least one alloying material; and exposing at least a portion of the contacted materials to the beam of high energy radiation for a time sufficient to form the oxalloy;

wherein the alloying material is one or more materials selected from the group consisting of B, Al, Si, Ti, V. Cr, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, rare earths, mixtures thereof, alloys thereof, oxygen containing salts thereof, and oxides of Ga.

33. The method of claim 1 wherein the irradiation is sufficient to form an oxalloy in at least substantially all of the surface area irradiated with the beam of high energy radiation.

34. The method of claim 2 wherein the irradiation is sufficient to form an oxalloy in at least substantially all of the surface area irradiated with the beam of high energy radiation.

35. The method of claim 3 wherein the irradiation is sufficient to form an oxalloy in at least substantially all of the surface area irradiated with the beam of high energy radiation.

36. The product producted by the method of claim 31.

37. The product produced by the method of claim 32.

38. A method for forming oxalloys of magnesium containing materials or aluminum containing materials comprising:

contacting an alloying material with magnesium containing materials or aluminum containing materials; and irradiating the contacted materials with a beam of high energy radiation in the presence of an oxidizing atmosphere; wherein the irradiation is of sufficient energy to form an oxalloy of at least a magnesium and at least one alloying material;

wherein the alloying material is one or more materials selected from the group consisting of B, Al, Si, Ti, V, Mn, Fe, Co, Ni, Cu, Zn, Ge, As, Zr, Nb, Mo, Ru, Rh, Pd, Ag, Cd, In, Sn, Sb, Hf, Ia, W, Re, Os, Ir, Pt, Au, Tl, Pb, Bi, Th, rare earths, oxide containing salts thereof, alloys thereof, and mixtures thereof.

39. A method for forming oxalloys of magnesium containing material comprising:

contacting magnesium containing materials with an alloying material; and irradiating the contacted materials with a beam of high energy radiation in the presence of an oxidizing atmosphere; wherein the irradiation is of sufficient energy to form an oxalloy;

wherein the alloying material is one or more materials selected from the group consisting of B, Al, Si, Ti, V, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, rare earths, mixtures thereof, alloys thereof, oxygen containing salts thereof, and oxides of Ga.

40. A method for forming oxalloys of aluminum containing materials comprising:

contacting an alloying material with aluminum containing materials; and irradiating the contacted materials with a beam of high energy radiation in the presence of an oxidizing atmosphere; wherein the irradiation is of sufficient energy to form an oxalloy;

wherein the alloying material is one or more materials selected from the group consisting of B, Al, Si, Ti, V, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, Ga, rare earths, alloys thereof, oxygen containing salts thereof, and mixtures thereof, and oxides of Ga.

41. A method for forming oxalloys of magnesium containing materials or aluminum containing materials comprising:

contacting an alloying material with magnesium containing materials or aluminum containing materials;

irradiating the contacted materials with a beam of high energy radiation in the presence of oxygen; and reacting the oxygen with the contacted materials to form an oxalloy of at least magnesium or aluminum and at least one alloying material;

wherein the alloying material is one or more materials selected from the group consisting of B, Al, Si, Ti, V, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, rare earths, oxide containing salts thereof, alloys thereof, and mixtures thereof.

42. A method of forming oxalloys of magnesium containing materials comprising:

contacting magnesium containing materials with an alloying material;

irradiating the contacted materials with a beam of high energy radiation in the presence of oxygen; and reacting the oxygen with the contacted materials to form an oxalloy of at least magnesium and at least one alloying material;

wherein the alloying material is one or more materials selected from the group consisting of B, Al, Si, Ti, V, Cr, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, rare earths, mixtures thereof, alloys thereof, oxygen containing salts thereof, and oxides of Ga.

43. A method for forming oxalloys of aluminum containing materials comprising:

contacting an alloying material with aluminum containing materials;

irradiating the contacted materials with a beam of high energy radiation in the presence of oxygen; and reacting the oxygen with the contacted material to form an oxalloy of at least aluminum and at least one alloying material;

wherein the alloying material is one or more materials selected from the group consisting of B, Al, Si, Ti, V, Cr, Mn, Fe, Co, Ni, Cu, Zn, Ge, As, Zr, Nb, Mo, Ru, Rh, Pd, Ag, Cd, In, Sn, Sb, Hf, Ta, W, Re, Os, Ir, Pt, Au, Tl, Pb, Bi, Th, Ga, rare earths, alloys thereof, oxygen containing salts thereof, and mixtures thereof, and oxides of Ga.

* * * * *

UNITED STATES PATENT AND TRADEMARK OFFICE

CERTIFICATE OF CORRECTION

PATENT NO. : 4,613,386

DATED : Sep. 23, 1986

INVENTOR(S) : Ronald L. Yates; Patrick L. Hagans

It is certified that error appears in the above-identified patent and that said Letters Patent is hereby corrected as shown below:

Col. 12, Claim 2, line 27, delete "orradiation" and insert --irradiation--.

Col. 12, Claim 4, line 62, delete "materiala" and insert --materials--.

Col. 13, Claim 29, line 61, after "for a" insert --time sufficient to form the oxalloy;--.

Col. 15, Claim 36, line 5, delete "producted" and insert --produced--.

Col. 15, Claim 38, line 23, delete "Ia" and insert --Ta--.

Col. 16, Claim 42, line 21, delete "of", first occurrence, and insert --for--.

Signed and Sealed this

Twenty-second Day of September, 1987

*Attest:*

DONALD J. QUIGG

*Attesting Officer* *Commissioner of Patents and Trademarks*